US005573156A

United States Patent [19]

McConnell

[11] Patent Number: 5,573,156

[45] Date of Patent: Nov. 12, 1996

[54] INFANT SEAT SLING APPARATUS

[76] Inventor: Thomas E. McConnell, 1568 Calzada Ave., Santa Ynez, Calif. 93460

[21] Appl. No.: 445,659

[22] Filed: May 22, 1995

[51] Int. Cl.[6] ..... A61G 1/00; A61G 5/00

[52] U.S. Cl. ..... 224/158; 224/201; 224/600; 224/608; D3/213; D3/214

[58] Field of Search ..... 224/158, 201, 224/202, 206, 600, 607, 608, 610; D3/213, 214

[56] References Cited

U.S. PATENT DOCUMENTS

| | | | |
|---|---|---|---|
| D. 143,283 | 6/1945 | De Pirro | D3/213 |
| 2,846,699 | 5/1956 | Watson | 224/158 |
| 3,492,680 | 2/1970 | Coolidge | 5/99 |
| 5,333,769 | 8/1994 | Skroski | 224/158 |

*Primary Examiner*—Renee S. Luebke

*Assistant Examiner*—Timothy L. Maust

*Attorney, Agent, or Firm*—Stetina Brunda & Buyan

[57] ABSTRACT

An infant seat sling apparatus for carrying of an infant seat having an infant seated or resting thereon. The sling apparatus comprises a receptacle sized and configured to receive said infant seat and an over-the shoulder strap whereby said receptacle may be suspended from the shoulder of an adult human being. The apparatus is preferably of compactable or flexible construction so as to be alternately changeable between a) an open (i.e., operative) configuration and b) a collapsed (i.e., stowable) configuration. A storage pouch may be provided for holding the apparatus when in its collapsed configuration. The apparatus is useable in conjunction with various commercially available infant seats and effectively distributes the weight of the infant and seat across the adult's back thereby significantly reducing fatigue and freeing one or both of the adult's arms for other activities.

4 Claims, 1 Drawing Sheet

INFANT SEAT SLING APPARATUS

FIELD OF THE INVENTION

The present invention pertains generally to child-care equipment and more particularly to a sling apparatus for carrying a child who is positioned on an infant seat.

BACKGROUND OF THE INVENTION

Various infant seats are well known in the prior art. As referred to herein, the typical infant seat comprises a rigid shell formed of molded plastic or the like, and having an upper surface, often a padded surface, upon which an infant or small child may be positioned. Such infant seats typically include a full back/head support which extends slightly above the head of the infant such that the entire torso and head of the infant may rest against the upper surface of the infant seat. Examples of commercially available infant seats of the prior art include the following: Century Model 565; Century Model 590; Kolcraft Infant Rider Model 13822; Kolcraft Rock 'N Ride Model 13101; and others.

Although some infant seats of the prior art are sufficiently portable to be carried within the arms of an adult human being, such carrying of the infant/child seat typically requires use of one or both arms of the adult. Even though some infant/child seats incorporate a handle, it is typically necessary for an adult human being to continually utilize one hand to grasp the handle of the infant seat. Thus, carrying an infant or small child within an infant seat frequently impairs the ability of the adult to perform other tasks, such as wheeling a shopping cart, dialing a telephone, carrying other items, etc. . .

Accordingly, there exists a present need in the art for the invention of an infant seat apparatus which is configured to hold an infant or small child seated or resting on a infant seat, and which may be suspended or slung from the upper body (e.g., over the superior aspect of the shoulder) of an adult, thereby freeing the hands of the adult for other purposes.

SUMMARY OF THE INVENTION

The present invention specifically addresses the above referenced need in the prior art and generally comprises a sling apparatus for carrying an infant seat or child seat having an infant or small child seated or resting thereupon.

In accordance with the present invention, the infant seat sling apparatus may comprise a receptacle portion having a floor, at least one sidewall and an opening or aperture through which said infant seat may be inserted such that the infant seat will rest upon the floor of the receptacle, inboard of the sidewall thereof. A shoulder strap is attached to the receptacle portion, and is usable to suspend the receptacle from the shoulder of an adult user.

Further in accordance with the present invention, the apparatus and in particular the receptacle portion thereof, may be formed of compressible or pliable materials so as to be alternately deployable between a) an open (i.e., operative) configuration and a collapsed (i.e., stowable) configuration. In this regard, the receptacle portion of the apparatus may be formed of pliable fabric or material, and may incorporate one or more resilient frame members. The resilient frame members are preferably formed of spring metal wire or other material which is sufficiently bendable to permit the receptacle to be folded or compressed into said "collapsed" configuration, while being resiliently biased to said "open" configuration. In accordance with this aspect of the present invention, the apparatus may be utilized in combination with a carrying pouch or container configured to receive and hold the apparatus in its "collapsed" configuration. Furthermore, in embodiments which incorporate the resilient frame member(s), such resilient frame member may be sufficiently biased to cause the apparatus to automatically spring to its "open" configuration when removed from the carrying pouch or container.

Further in accordance with the invention, the sidewalls and/or end panels of the apparatus may be formed of loosely woven or mesh material so as to permit free passage of air therethrough.

Still further in accordance with the invention, a portion of the sidewall(s) may incorporate an elastic region or member operative to draw the sidewall inwardly such that the sidewall will elastically form around an infant seat inserted into the receptacle.

Still further in accordance with the invention, the over-the-shoulder strap is preferably connected to the receptacle in a manner which prevents tipping or side-to-side swaying of the receptacle when suspended from the shoulder of an adult human being. Additionally, the shoulder strap may be padded or cushioned in the region thereof which rides upon the shoulder of the adult human being.

Further objects and advantages of the invention will become apparent to those skilled in the art upon reading and understanding of the following detailed description of the preferred embodiment, in conjunction with the accompanying drawings.

DETAILED DESCRIPTION OF THE PREFERRED EMBODIMENT

Figure 1:
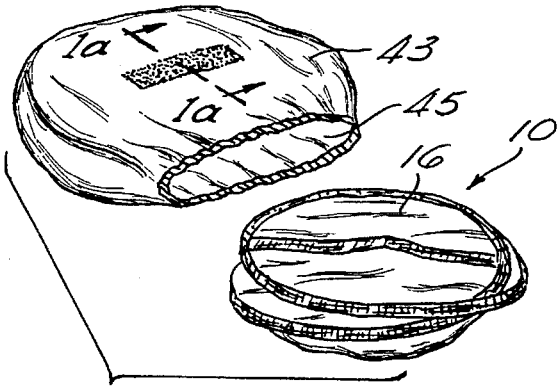
FIG. 1 is an exploded perspective view of a preferred infant seat sling apparatus of the present invention disposed in a collapsed configuration, and positioned next to a carrying case therefore.

The following detailed description and the accompanying drawings are provided for purposes of describing and illustrating presently preferred embodiments of the invention only, and are not intended to limit the scope of the invention, or the scope of the following claims in any way.

With reference to the drawings, the infant seat sling apparatus 10 of the present invention comprises an infant seat receiving receptacle 12 and an over-the-shoulder strap member or strap system 14 attached thereto. In the preferred embodiment, the receptacle 12 of the apparatus 10 comprises a flat, pliable floor panel 16 and a pliable sidewall 18. The bottom edge of the sidewall 18 is connected or conjoined to the outer edge of the floor panel 16 and the sidewall 18 extends generally upwardly therefrom. The upper edge 22 of the sidewall 18 defines a mouth or opening 24 to permit insertion of a conventional infant seat IS (shown in FIG. 5) into the receptacle 12 such that the infant seat IS will rest on the floor panel 16, inboard of the sidewall 18.

In the specific embodiment shown, the receptacle floor panel 16 is formed having a generally ovoid shape and the mesh sidewall 18 is formed having a generally oval shaped sidewall 18 which extends upwardly from the oval shaped periphery of the floor 16. The bottom edge 20 of the ovoid, mesh sidewall 18 is affixed to the periphery of the floor panel 16. The upper edge 22 of the sidewall 18 forms an oval-shaped opening 24. The bottom edge 20 and the top edge 22, in conjunction with the shoulder strap attachment members 36*a* and 36*b* and the shoulder strap 30 form a webbing design that carries most of the loads through the sling 10. In the preferred embodiment, an elastic region, such as an elastic strip 26, may be located near the upper edge 22 of the sidewall 18 to elastically draw the sidewall 18 inwardly, thereby causing the upper portion of the sidewall 18 to conform inwardly against an infant seat IS positioned within the receptacle 12. (See FIG. 5)

The over-the shoulder strap system 14 of the preferred embodiment comprises a single shoulder strap member 30 having a shoulder pad 32 disposed thereon. An adjustment buckle 34 is associated with the shoulder strap 30 to permit the length of the shoulder strap 30 to be adjusted. Shoulder strap attachment members 36*a* and 36*b* facilitate attachment of opposite ends of the shoulder strap 30 to opposite ends of the receptacle 12. Each shoulder strap attachment member 36*a* and 36*b* is concurrently affixed to opposite sides of the receptacle 12 to evenly distribute the weight of the receptacle 12, when suspended from the shoulder strap 30, thereby minimizing or preventing any side-to-side tilting of the receptacle 12 during use. In this regard, the preferred shoulder strap attachment members 36 comprise inverted "U" shaped attachment straps 38 having opposite bottom ends 40*a* and 40*b* connected to opposite lateral sides of the receptacle 12, as shown. The apex 42 of each inverted "U" shaped attachment strap 38 is passed through a connector ring 44 connected to one end of the shoulder strap 30, thereby establishing connection of the receptacle 12 to the shoulder strap 30, while allowing the connector strap 38 to slide back and forth through connector rings 44, thereby permitting some side to side play or automatic adjustment of the attitude of the receptacle 12 when suspended from the shoulder strap 30. Fabric or mesh webbing panels 46 may be disposed within the lower portions of each inverted "U" shaped connector strap 38, as shown. In the preferred embodiment the edges of the webbing panels 46 are attached to a respective resilient plastic member 49 which conforms the shape of the webbing panels to the shape of the strap 38 while allowing the connector ring 44 to freely travel.

In the preferred embodiment, the floor panel 16 is formed of tightly woven fabric, such as nylon, while the sidewall 18 and webbing panels 46 are formed of mesh or net-like material, such as that commercially available as mosquito nets, washing machine bags, stroller bags, etc.

Figure 3:
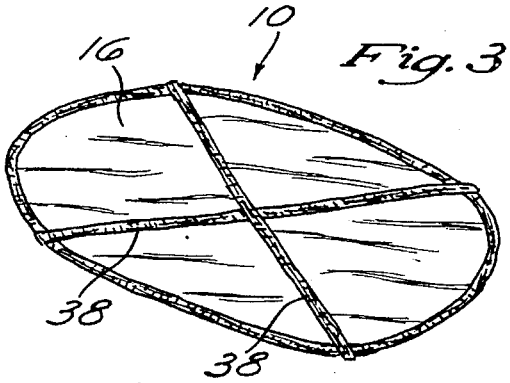
FIG. 3, is a bottom perspective view of the preferred infant sling apparatus of FIG. 2.

In the embodiment shown, the connector straps 38 extend downwardly over the side-wall 18, and cross or traverse one another on the underside of the floor 16, as shown in FIG. 3. Such extension and crossing or traversal of the connector straps 38 serves to transfer almost all of the load to the strong connector straps 38, rather than the weaker mesh or net-like materials used.

Figure 2:
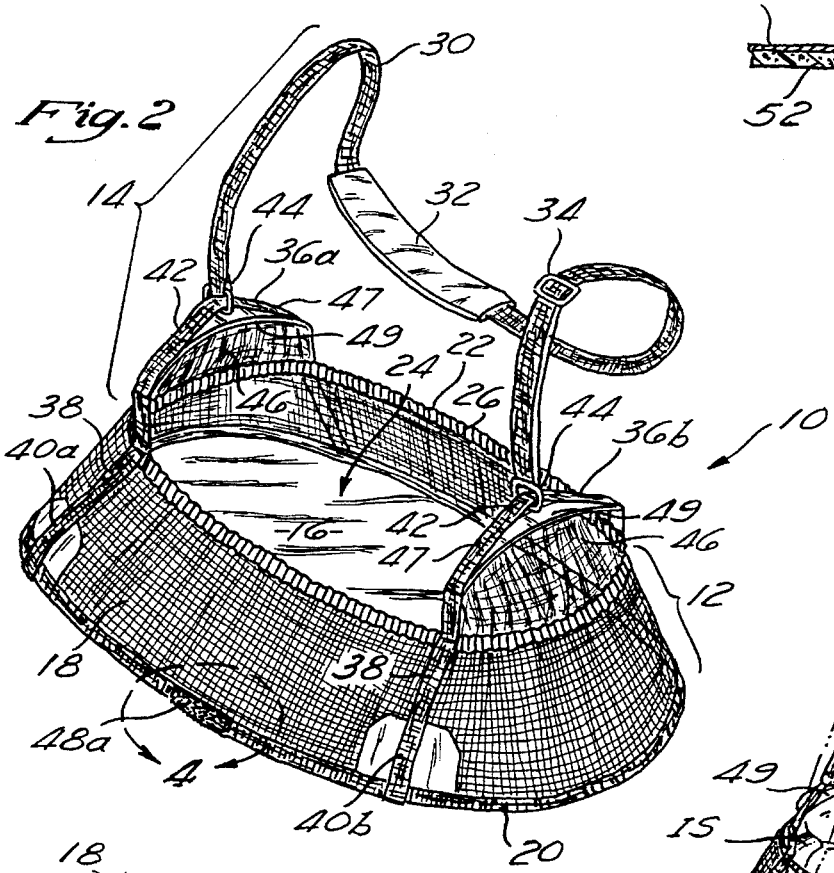
FIG. 2, is a perspective view of a preferred infant seat sling apparatus of the present invention disposed in an open operative configuration.

In the preferred embodiment, a spring metal frame 40 is disposed within or attached to the receptacle 12, about the periphery of the floor 16 thereof. Such spring metal frame 40 is preferably biased to an oval shape such that, when non-compressed, such spring metal frame 40 will cause the receptacle 12 to resiliently assume a fully open configuration, as shown in FIG. 2. Additionally, such spring metal frame 40 is sufficiently bendable to allow the device 10 to be folded into a fully collapsed configuration, as shown in FIG. 1.

Also, in the preferred embodiment, a support member 49 is attached to the central portion 47 of each attachment strap 38, to maintain a circuitous form to the central portion 47, with only a localized apex 42. Additionally, the webbing panels 48 are gathered (as shown in FIG. 2), to transfer loads from the top edge 22 to the support member 49 and into the attachment straps 38.

A storage container, such as a storage pouch 43 may be provided for use in conjunction with the apparatus 10. The preferred storage pouch 43 has a mouth or opening 45 formed therein, and is sized and configured to receive therewithin the apparatus 10 when the apparatus 10 is folded or compressed to its collapsed configuration (FIG. 1). In this regard, when the collapsed apparatus 10, as shown in FIG. 1, is inserted into the storage pouch 43 the storage pouch 43 will hold the apparatus 10 in such collapsed configuration. However, when the apparatus 10 is removed from the storage pouch 43, the resilient spring frame 40 will cause the apparatus 10 to spring open into its "open" or operative configuration, as shown in FIG. 2.

Figure 5:
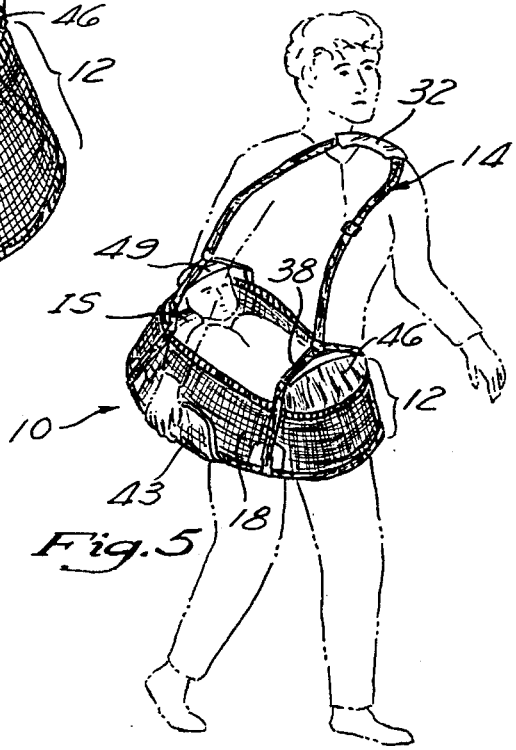
FIG. 5, is a perspective view of a preferred infant sling apparatus of the present invention having an infant and infant seat operatively positioned therein, and being operatively slung from the shoulder of an adult user.

In operation, the strap length adjustment buckle 34 is utilized to adjust the length of the shoulder strap 30 such that, when the shoulder strap member or system 14 is positioned over the shoulder of an adult human being, as shown in FIG. 5, the receptacle 12 portion of the apparatus 10 will be suspended along side or in front of the body of the adult human being. An infant or small child seated or resting upon an infant seat IS is insertable through the opening 24 such that the infant seat IS becomes positioned on the upper surface of the floor panel 16 inboard of the sidewall 18. The elastic strip 26 disposed about the upper edge 22 of the sidewall 18 causes the sidewall 18 to elastically conform or retract inwardly, around the infant seat IS, as shown in FIG. 5. Thus, the infant or small child seated or resting on the infant seat IS, is securely positioned within the receptacle 12 of the sling apparatus 10, while the sling apparatus 10 is suspended or hung over the shoulder of the adult human being.

Figure 1A:
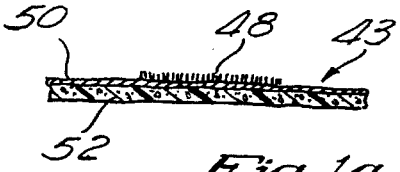
FIG. 1*a*, comprises a cross-sectional view taken about lines 1*a*—1*a* of FIG. 1.
Figure 4:
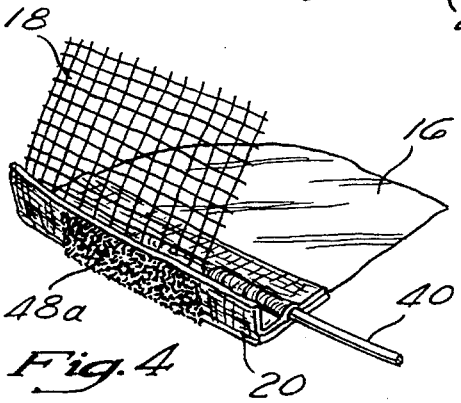
FIG. 4,is an enlarged cut-away perspective view taken about aspect line "4" of FIG. 2.

When the sling 10 is in use, the pouch 43 (FIG. 1), preferably fabricated of a foam backed nylon material (i.e., a nylon cover 50 and a foam lining 52) (FIG. 1*a*), may be used as a pad between the carrying adult's body and the plastic surfaces commonly present on the infant seat IS. Preferably, a strip of velcro 48 is formed to the pouch 43, to facilitate fastening of the pouch 43 to the receptacle 12. A corresponding strip of velcro 48*a* is attached to the sidewall 18 at the lower edge 20, preferably on both sides of the receptacle 12. (FIG. 4). The pouch 43, operative as a pad, is preferably fastened to the receptacle 12 between the sling 10 containing the infant seat IS and the carrying adult's hip (not shown). Alternatively, the pouch 43 could be fastened to the opposite side of the receptacle 12 (FIG. 5), to protect the carrying adults hand from the infant seat IS.

Although the invention has been described hereabove with reference to a presently preferred embodiment, it will be appreciated that various alterations, modifications and changes may be made to the above-described embodiment without departing from the intended spirit and scope of the invention. It is intended that all such additions deletions and modifications be included within the scope of the following claims and the equivalents thereof.

What is claimed is:

1. An infant seat sling apparatus for carrying an infant seat having an infant child seated thereon, said apparatus comprising:

a receptacle sufficiently collapsible to be alternately deployed in:

i) an open configuration wherein said receptacle is configured to receive and hold an infant seat having said infant child positioned thereon; and ii) a collapsed configuration wherein said receptacle is stowable within a storage pouch;

said receptacle having a floor, at least one sidewall, and an opening formed therein;

a resilient frame member associated with said receptacle, said frame member being biased to urge said receptacle toward said open configuration, and said frame member being sufficiently bendable to permit said receptacle to be voluntarily deployed in said collapsed configuration;

a shoulder strap attached to said receptacle and passable over the shoulder of an adult human being such that said receptacle will be suspended therefrom;

wherein said floor of said receptacle comprises a flat panel having an upper surface, a lower surface and an outer peripheral edge, and wherein said sidewall of said receptacle has an upper edge and a lower edge, the lower edge of said sidewall being conjoined to the peripheral edge of said floor such that said sidewall extends generally upward about the periphery of said floor;

with the apparatus further comprising an elastic member positioned about said sidewall, near the upper edge thereof, to elastically draw said sidewall inwardly such that said sidewall will conform about an infant seat positioned on the floor of said receptacle.

2. An infant seat sling apparatus for carrying an infant seat having an infant child seated thereon, said apparatus comprising:

a receptacle sufficiently collapsible to be alternately deployed in:

i) an open configuration wherein said receptacle is configured to receive and hold an infant seat having said infant child positioned thereon; and ii) a collapsed configuration wherein said receptacle is stowable within a storage pouch;

said receptacle having a floor, at least one sidewall, and an opening formed therein;

a resilient frame member associated with said receptacle, said frame member being biased to urge said receptacle toward said open configuration, and said frame member being sufficiently bendable to permit said receptacle to be voluntarily deployed in said collapsed configuration;

a shoulder strap attached to said receptacle and passable over the shoulder of an adult human being such that said receptacle will be suspended therefrom;

wherein said floor of said receptacle is generally ovoid in configuration and said sidewall is positioned about the periphery of said generally ovoid floor.

3. An infant seat sling apparatus for carrying an infant seat having an infant child seated thereon, said apparatus comprising:

a receptacle configured to receive and hold an infant seat having an infant child seated thereon, said receptacle having a floor, at least one sidewall, and an opening formed therein; and a shoulder strap attached to said receptacle and passable over the shoulder of an adult human being such that said receptacle will be suspended therefrom, said shoulder strap comprises an elongate strap having first and second ends, the first and second ends of said shoulder strap being connected to opposite ends of said receptacle;

wherein first and second should strap attachment members are formed on opposite ends of said receptacle, to facilitate attachment of the first and second ends of said shoulder strap thereto, said first and second shoulder strap attachment members comprise inverted "U" shaped straps having lower ends attached to said receptacle; and a fabric web connected to and traversing between opposite sides of said inverted "U" straps;

wherein said inverted "U" shaped straps have a circuitous central portion which extends upwardly from said receptacle, and to which one end of said shoulder strap is attached;

with the apparatus further comprising a resilient support member associated with said circuitous central portion, to maintain the circular shape.

4. An infant seat sling apparatus for carrying an infant seat having an infant child seated thereon, said apparatus comprising:

a receptacle configured to receive and hold an infant seat having an infant child seated thereon, said receptacle having a floor, at least one sidewall, and an opening formed therein; and a shoulder strap attached to said receptacle and passable over the shoulder of an adult human being such that said receptacle will be suspended therefrom, said shoulder strap comprises an elongate strap having first and second ends, the first and second ends of said shoulder strap being connected to opposite ends of said receptacle;

wherein first and second shoulder strap attachment members are formed on opposite ends of said receptacle, to facilitate attachment of the first and second ends of said shoulder strap thereto, said first and second shoulder strap attachment members comprise inverted "U" shaped straps having lower ends attached to said receptacle; and a fabric web connected to and traversing between opposite sides of said inverted "U" straps;

wherein said inverted "U" shaped straps extend across the under surface of said receptacle floor.

* * * * *